United States Patent [19]

Shores, Sr.

[11] Patent Number: 4,833,786

[45] Date of Patent: May 30, 1989

[54] ADJUSTABLE PEEP SIGHT

[76] Inventor: Ronald G. Shores, Sr., P.O. Box 1025, Phenix City, Ala. 36868-1025

[21] Appl. No.: 233,003

[22] Filed: Aug. 17, 1988

[51] Int. Cl.[4] ..... F41G 1/00

[52] U.S. Cl. ..... 33/265; 33/251

[58] Field of Search ..... 33/265, 251; 124/87, 124/90, 114.5, 135 N, 135 R

[56] References Cited

U.S. PATENT DOCUMENTS

| | | | |
|---|---|---|---|
| 3,456,351 | 7/1969 | Gehmann | 33/251 |
| 4,011,853 | 3/1977 | Fletcher | 33/265 |
| 4,116,194 | 9/1978 | Topel | 33/265 X |
| 4,625,422 | 12/1986 | Carlson | 33/265 |

*Primary Examiner*—Harry N. Haroian

*Attorney, Agent, or Firm*—Fleit, Jacobson, Cohn & Price

[57] ABSTRACT

A hollow cylindrical body is provided including a pair of relatively thin flexibly resilient transverse discs mounted therein. The discs include central openings and include radial slits therein spaced about the openings and extending outward toward outer marginal portions of the discs. An annular wedge is mounted within the body and engageable against the inwardly tapering finger portions of one of the discs defined between the slits therein for laterally deflecting the inner end portions of those fingers, as well as the fingers of the adjacent disc, longitudinally of the body to thus increase the diameter of the sight window defined between the radial inner ends of the fingers, the slits formed in each disc being spaced between the slits formed in the other disc. Further, the body includes opposite outerside diagonal grooves therein for receiving the two lateral halves of an untwisted portion of a bow string therein as well as an outer circumferential groove intersecting with the longitudinal mid-portions of the diagonal grooves and in which a circumferentially extending wrap may be secured for tightly clamping the bow string halves to the body.

11 Claims, 1 Drawing Sheet

ADJUSTABLE PEEP SIGHT

BACKGROUND OF THE INVENTION

FIELD OF THE INVENTION

This invention relates to a small barrel-shaped peep sight assembly for use in conjunction with a hunting bow and includes opposite side diagonal grooves in which the two lateral halves of an untwisted portion of a bow string may be received, the outer surface of the barrel-shaped peep sight also including a circumferential groove intersecting with the longitudinal mid-portions of the diagonal grooves and in which a circumferentially extending wrap may be secured extending over the bow string halves disposed in the diagonal grooves.

In addition, the peep sight is tubular in configuration and defines a longitudinal passage extending therethrough. A pair of thin flexibly resilient and stiff material annular discs are mounted from the housing within and disposed transverse to the passage and each of the discs defines a central generally circular opening formed therethrough and has a plurality of circumferentially spaced, generally radial slits formed therein defining generally radial inwardly tapering fingers extending inward from outer marginal portions of the corresponding discs to the central opening and the discs are axially abutted mounted within the passage with the central openings thereof registered with each other and with the slits of one disc circumferentially spaced between the slits of the other disc. An annular abutment portion is mounted within the passage and shiftable longitudinally therealong to engage and adjustably laterally deflect the base ends of the fingers to thereby vary the diameter of the opening defined by the discs while maintaining the openings substantially circular.

DESCRIPTION OF RELATED ART

Various different forms of peep sights and other structures including some of the general structural and operational features of the instant invention are disclosed in U.S. Pat. Nos. 1,428,389, 3,410,644, 3,456,351, 3,667,444, 4,366,625 and 4,656,747. However, these previously known devices do not include the overall combination of structural features of the instant invention by which the peep sight of the instant invention is mounted from an associated bow string and also by which the diameter of the sighting opening defined by the peep sight may be varied while maintaning the opening substantially cylindrical.

SUMMARY OF THE INVENTION

The peep sight of the instant invention is designed primarily to be used in conjunction with a hunting bow (or for target practice) and includes novel structure by which the peep sight may be mounted from an associated bow string.

In addition, the peep sight is constructed in a manner whereby the diameter of the sighting opening defined thereby may be adjustably varied while maintaining the sighting opening substantially circular.

The main object of this invention is to provide a peep sight defining a central sight opening therethrough and constructed in a manner whereby the diameter of the sight opening may be adjustably varied while maintaining the sight opening at least substantially circular.

Another object of this invention is to provide a peep sight constructed in a manner whereby the diameter of the sight opening therein may be readily varied.

Still another object of this invention is to provide a peep sight including structure facilitating ready mounting of the peep sight from the bow string of an archery bow.

A final object of this invention to be specifically enumerated herein is to provide a peep sight constructed in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
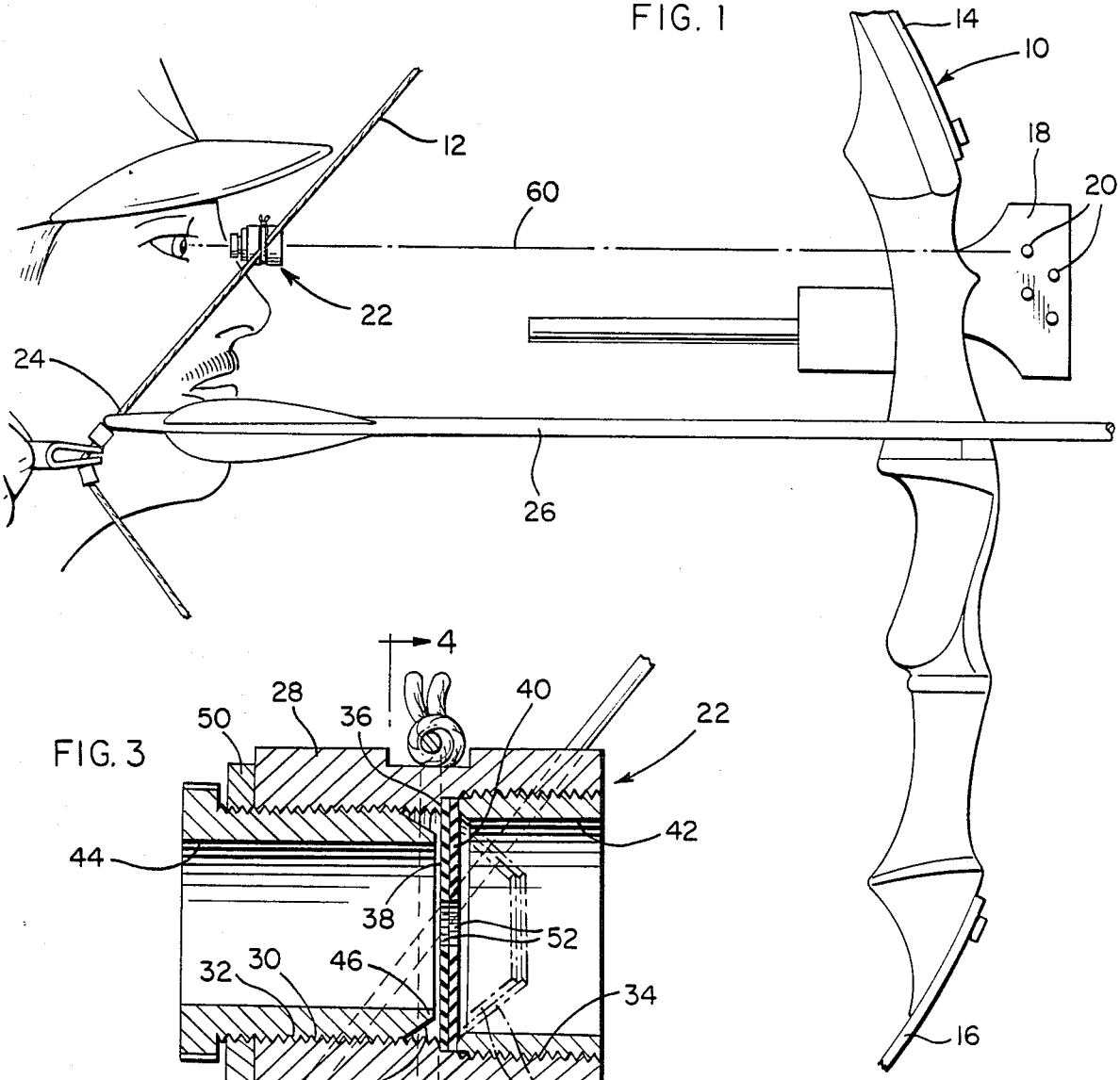
FIG. 1 is a side elevational veiw of the peep sight of the instant invention mounted upon the bow string of a drawn bow and with the peep sight horizontally registered with an upper sighting pin on the body of the bow.

Referring now more specifically to the drawings, the numeral 10 generally designates a conventional form of archery bow including bow string 12 strung between the free ends of the arms 14 and 16 of the bow 10. The bow 10 includes a sighting device 18 mounted on the body thereof including vertically spaced sighting pegs 20 and the peep sight of the instant invention is referred to in general by the reference numeral 22 and illustrated in FIG. 1 of the drawings mounted upon the bow string 12 in horizontal alignment with the uppermost peg 20, the peep sight 22 being mounted on the bow string 12 a spaced distance above the arrow nocking position 24 thereon with which an associated arrow 26 is engaged.

The peep sight 22 includes a barrel-shaped housing 28 defining a central passage 30 extending longitudinally therethrough. The passage 30 is threaded as at 32 and one end of the passage 30 includes an enlarged threaded counterbore 34.

The inner end of the counterbore 34 terminates at an annular radial shoulder 36 against which the outer marginal portion of a pair of discs 38 and 40 are abutted. The discs 38 and 40 are constructed by any suitable material which is flexibly resilient and stiff and the discs 38 and 40 are made as thin as operationally possible for a purpose to be hereinafter more fully set forth. The thickness of the discs 38 and 40 illustrated in FIG. 3 may be considered as exaggerated.

An externally theaded retaining sleeve 42 is threaded into the counterbore 34 to retain the discs 38 and 40 clamped together and seated against the shoulder 36 and an abutment sleeve 44 is threaded into the passage 30 on the side of the discs 38 remote from the retaining sleeve 42. The end of the abutment sleeve 44 opposing the disc 38 includes an annular abutment portion 46 which is externally bevelled as at 48 and a lock nut 50 is threaded on the exterior of the sleeve 44 and abutted against the end of the housing 38. Thus, abutment sleeve 44 may be releasably locked in adjusted position within the passage 30.

Figure 4:
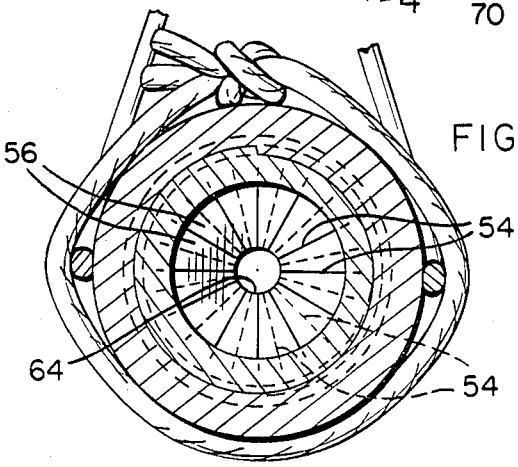
FIG. 4 is a vertical sectional view taken substantially upon the plane indicated by section line 4—4 of FIG. 3.

Each of the discs 38 and 40 defines a central opening 52 therethrough and is further equipped with radial slits 54 spaced about the corresponding opening 52 and extending radially outwardly therefrom to a point spaced inward of the outer marginal portion of the disc. The radial slits 54 define inwardly tapering fingers 56 therebetween and the discs 38 and 40 are registered with each other such that the slits 54 of one disc are spaced intermediate the slits 54 of the other disc. Also, it will be noted from FIG. 4 of the drawings that the fingers 56 include blunt inner ends which are each half overlapped peripherally about the corresponding opening 52 by the adjacent fingers 56 of the other disc.

Figure 3:
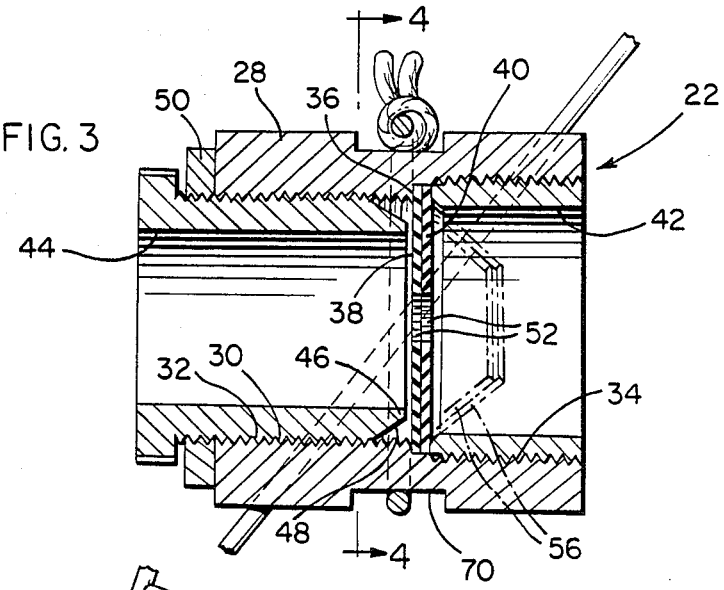
FIG. 3 is an enlarged vertical sectional view taken substantially upon the plane indicated by section line 3—3 of FIG. 2.

The openings 52 define a sight window therethrough along the sight path 60 illustrated in FIG. 1 and the diameter of the window 60 may be increased by loosening the lock nut 50 and inwardly threading the abutment sleeve 44 such that the annular abutment portion 46 thereof engages the fingers 56 of the disc 38 to laterally deflect the inner ends of the fingers 56 of both discs 38 and 40 to the right as viewed in FIG. 3. This of course increases the size of the opening and because the inner ends of each of the fingers 54 are peripherally overlapped by the fingers 54 of the other disc the size of the sight window may be increased to twice the circumference of the smallest sight window 64 illustrated in FIG. 4 before any spacing occurs between the inner ends of adjacent fingers 56.

Because the discs 38 and 40 are made as reasonably thin as possible, deflection of the fingers 56 of the discs 38 and 40 does not appreciably foreshorten the fingers 56 of the disc 38 relative to the fingers 56 of the disc 40. Thus, the sight window 64 remains substantially circular.

In FIG. 3 of the drawings, the phantom line positions of the fingers 56 are exaggerated. In most instances, the sight window will not be increased to the diameter illustrated in FIG. 3, but FIG. 3 does illustrate the extent to which the fingers 56 may be laterally displaced, if desired.

An intermediate length portion of the housing 28 includes an outer circumferential groove 70 formed therein and opposite sides of the housing 28 include outer diagonal grooves 72 formed therein, the groove 70 intersecting with the longitudinal mid-portions of the grooves 72.

Figure 2:
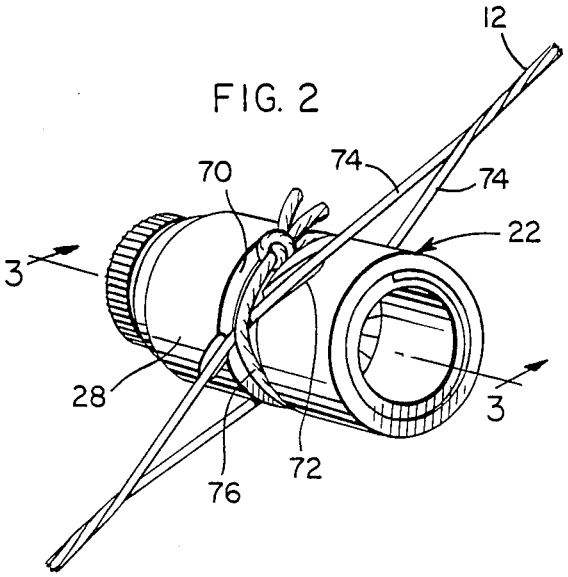
FIG. 2 is an enlarged perspective view of the peep sight and adjacent portions of the associated bow string illustrating the manner in which the peep sight is mounted upon the bow string.

The bow string 12 is unwound in the area of the desired mounting of the peep sight 22 and the two lateral halves 74 of the bow string 12 receive the housing 28 therebetween with the bow string halves 74 received in the grooves 72. Then, an anchor wrap or tie is made through the utilization of a string 76 or other suitable structure with the tie or wrap 76 seated in and extending about the circumferential groove 70 and tightly clamped over the bow string halves 74, see FIG. 2.

This type of securement of the peep sight 22 to the bow string 12 allows the initial positioning of the peep sight 22 on the string 12 to be readily observed if a "tic" mark is made on each bow string half 74 at the point the wrap 76 is secured thereover. Then, if it is desired to slightly shift the peep sight 22 along the bow string 12, it is merely necessary to force the housing 28 along the string 12 with the string halves 74 sliding beneath the wrap or string 76.

The peep sight 22 may be used in conjunction with the pegs 20 for aiming at various target distances and the size of the sight window 64 may be increased or decreased as desired by adjustment of the abutment sleeve 44. Further, the exterior surfaces of the lock nut 50 and adjacent unthreaded enlarged portion of the exterior of the abutment sleeve 44 may be knurled as desired to facilitate a better manual grip thereon. Also, it is to be noted that the size of the sight window 64 will be adjusted according to different size targets and the amount of ambient light.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. An adjustable peep sight for a projectile launching device, said sight including a housing defining an elongated passage extending therethrough, a pair of thin flexibly resilient and stiff material annular discs mounted from said housing in and transverse to said passage, each of said discs defining a central, generally circular opening formed therethrough and having a plurality of circumferentially spaced, generally radial slits formed therein defining generally radial, inwardly tapering fingers extending inward from the outer marginal portion of the corresponding disc to the central opening therein, said discs being mounted within said passage with said central openings axially registered and the width of said discs at least substantially axially abutted and the slits of one of said discs circumferentially spaced between the slits of the other disc, and wedge means mounted from said housing and adjustably shiftable along said passage, said wedge means including an annular abutment portion disposed in said passage on the side of one of said discs remote from the other disc and facing and abuttingly engageable with the fingers of said one disc intermediate the opposite ends of the last-mentioned fingers to variably deflect the fingers of said one disc, and thus also the fingers of the other disc, along said passage, responsive to shifting of said wedge means in the direction in which said annular abutment portion faces, said housing including mounting means adapating said housing to be mounted from a suitable portion of said device.

2. The peep sight of claim 1 wherein said housing is generally cylindrical and said passage extends centrally therethrough, one end of said passage including a counterbore, said discs being seated in said counterbore and removably retained therein by a retaining sleeve removably secured in said counterbore outwardly of said discs.

3. The peep sight of claim 2 wherein said counterbore is threaded and said retaining sleeve is removably threaded in said counterbore.

4. The peep sight of claim 2 wherein the other end of said passage is threaded and said wedge means comprises a sleeve member adjustably threaded in said other end of said passage and said annular abutment portion comprises the end of said sleeve member opposing said one disc.

5. The peep sight of claim 4 wherein said end of said sleeve member is externally bevelled.

6. The peep sight of claim 4 wherein said sleeve member projects outwardly of the end of said cylindrical housing corresponding to said other end of said passage, and a lock nut threaded on said sleeve member and abuttingly engageable with said housing end.

7. The peep sight of claim 6 wherein said end of said sleeve member is externally bevelled.

8. The peep sight of claim 7 wherein said counterbore is threaded and said retaining sleeve is removably threaded in said counterbore.

9. The peep sight of claim 1 wherein said housing is cylindrical and said mounting means includes opposite outerside diagonal grooves formed in said housing for receiving the two lateral halves of an untwisted portion of a bow string therein closely above the arrow nocking location on said bow string.

10. The peep sight of claim 9 wherein said housing also includes an outer circumferential groove formed therein intersecting with the longitudinal mid-portions of said diagonal grooves and in which a circumferentially extending wrap may be received extending over the bow string halves disposed in said diagonal grooves.

11. A peep sight structure for use in conjunction with an archery bow, said peep sight including a generally cylindrical body and defining a sighting window therein disposed generally transverse to said body, said body including opposite outerside diagonal grooves for receiving the two lateral halves of an untwisted portion of a bow string therein closely above the arrow nocking location on said bow string, said housing also including an outer circumferential groove formed therein intersecting with the longitudinal mid-portions of said diagonal grooves and in which a circumferentially extending wrap may be received for tightly clamping those portions of the bow string halves disposed in the longitudinal mid-portions of said diagonal grooves against said body.

* * * * *